US007117542B2

(12) United States Patent
Lee

(10) Patent No.: US 7,117,542 B2
(45) Date of Patent: Oct. 10, 2006

(54) HEADWEAR AND SWEATBAND WITH STRETCH STITCH LINE

(75) Inventor: Chul-Woo Lee, Seoul (KR)

(73) Assignee: Cap1 Co., Ltd., Seoul (KR)

( * ) Notice: Subject to any disclaimer, the term of this patent is extended or adjusted under 35 U.S.C. 154(b) by 0 days.

(21) Appl. No.: 10/992,901

(22) Filed: Nov. 19, 2004

(65) Prior Publication Data

US 2006/0048274 A1 Mar. 9, 2006

(30) Foreign Application Priority Data

Sep. 7, 2004 (KR) ..... 10-2004-0071436
Sep. 13, 2004 (KR) ..... 10-2004-0072968

(51) Int. Cl.
*A42B 1/22* (2006.01)

(52) U.S. Cl. ..... 2/181; 2/195.1; 2/175.1

(58) Field of Classification Search ..... 2/181, 2/195.1, 171.7, 195.5
See application file for complete search history.

(56) References Cited

U.S. PATENT DOCUMENTS 579,394 A * 3/1897 Iles ..... 2/181
1,139,318 A * 5/1915 Wheelock ..... 2/181
1,222,528 A * 4/1917 Cohen ..... 2/181
1,378,444 A * 5/1921 Colgrove ..... 2/181
1,411,509 A * 4/1922 Peters ..... 2/181
4,521,922 A * 6/1985 Mitchell et al. ..... 2/171
5,265,279 A * 11/1993 Mathis ..... 2/181
5,745,921 A * 5/1998 Mitchell et al. ..... 2/181
5,983,398 A * 11/1999 Kronenberger ..... 2/181
6,477,715 B1 * 11/2002 Shin ..... 2/181.4
6,625,818 B1 * 9/2003 Putnam ..... 2/181
6,817,035 B1 * 11/2004 Park ..... 2/181

* cited by examiner

*Primary Examiner*—Gary L. Welch
*Assistant Examiner*—Richale Haney
(74) *Attorney, Agent, or Firm*—O' Connell Law Firm

(57) ABSTRACT

The present invention discloses a headwear having a crown adapted to cover the top of a wearer's head, and a brim formed in a predetermined shape at the lower peripheral edge of the crown, and a rim formed along the inner peripheral surface of the lower peripheral edge of the crown, wherein the rim is made of an expandable spandex material and has a sewing line formed in a zigzag way along a portion where the upper and lower portions of the rim are folded to meet with each other so that the sewing line is strechable, the rim being sewn along the inner peripheral surface of the lower peripheral edge of the crown at the lower portion thereof.

2 Claims, 16 Drawing Sheets

PRIOR ART

HEADWEAR AND SWEATBAND WITH STRETCH STITCH LINE

BACKGROUND OF THE INVENTION

1. Field of the Invention

The present invention relates to a headwear that has an expandable rim that is formed along the inner peripheral surface of the lower peripheral edge of a crown thereof, and more particularly, to a headwear that is provided with a rim that is formed along the inner peripheral surface of the lower peripheral edge of a crown, the rim being made of a spandex material and having a sewing line formed in a zigzag way along a portion where the upper and lower portions of the spandex material are folded to meet with each other, thereby providing a high degree of expansion, such that the headwear is freely worn within the range of the degree of expansion, irrespective of the size of a wearer's head, thereby giving some advantages like an excellent sweat absorbing capability, conveniences in use, and satisfaction of wearing.

2. Background of the Related Art

Generally, a headwear is divided into a hat and a cap in accordance with the styles of brim, and they have a rim attached along the inner peripheral surface of the lower peripheral edge of a crown thereof. The rim is typically made of a fabric itself or a fabric with a non-woven seam material inserted thereinto.

The rim has non-expandable property and thus, most of caps have an adjustable headband formed at the rear portion of the crown and adapted to be tightened and loosened according to the size of a wearer's head.

In the case where the adjustable headband is formed at the rear portion of the crown, however, an additional clip device is provided to adjust the length of the headband. This embraces some disadvantages in that the manufacturing process becomes complicated, the production cost becomes high, and the outer appearance becomes not good.

In some cases, the rim is formed of an elastic rubber band, but it is made by weaving an elastic cord with a fabric material, such that it is substantially thick and has an irregular surface thereon. This also gives some defects in that a wearer cannot wear the cap with a good wearing feeling and the rubber material does not exhibit a good sweat absorbing capability.

So as to attach the rubber band along the inner peripheral surface of the inner peripheral edge of the crown of the cap, as shown in FIG. 1, upper and lower sewing lines 2*a* are formed in the form of a straight line along the upper and lower portions of the rubber band 2. In this case, the formation of the upper and lower sewing 1 lines 2*a* of the shape of straight line makes the elasticity of the rubber band 2 substantially decreased, such that the rubber band 2 fails to expand the inner peripheral portion of the crown in accordance with the size of a wearer's head. Thus, there is a need for a cap having a high degree of expansion.

SUMMARY OF THE INVENTION

Accordingly, the present invention has been made in view of the above-mentioned problems occurring in the prior art.

An object of the present invention is to provide a headwear that is provided with a rim that is formed along the inner peripheral surface of the lower peripheral edge of a crown, the rim being made of a spandex material and having a sewing line formed in a zigzag way along a portion where the upper and lower portions of the spandex material are folded to meet with each other, thereby providing a high degree of expansion, such that the headwear is freely worn within the range of the degree of the expansion, irrespective of a wearer's head size, thereby giving some advantages like an excellent sweat absorbing capability, conveniences in use, and satisfaction of wearing.

To accomplish the above object, according to the present invention, there is provided a headwear having a crown adapted to cover the top of a wearer's head, and a brim formed in a predetermined shape at the lower peripheral edge of the crown, and a rim formed along the inner peripheral surface of the lower peripheral edge of the crown, wherein the rim is made of an expandable spandex material and has a sewing line formed in a zigzag way along a portion where the upper and lower portions of the rim are folded to meet with each other so that the sewing line is strechable, the rim being sewn along the inner peripheral surface of the lower peripheral edge of the crown at the lower portion thereof.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
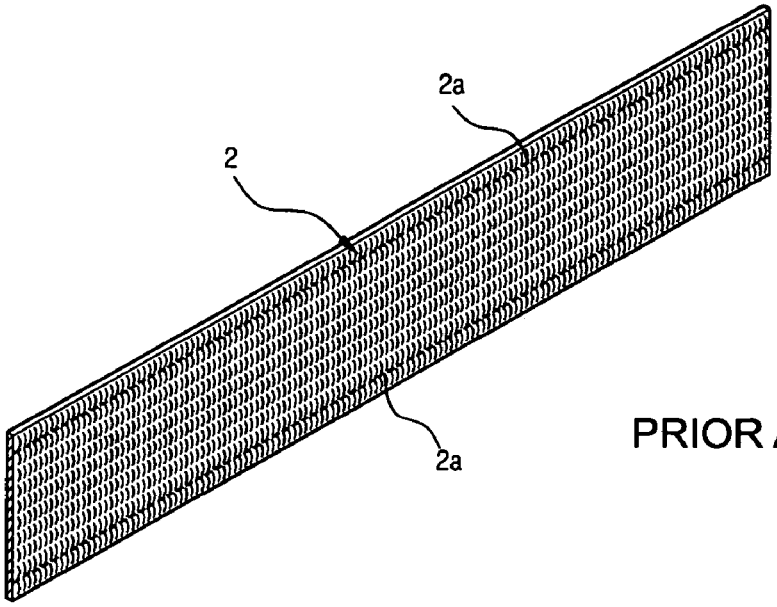
FIG. 1 is a perspective view of a conventional rubber band type rim.
Figure 2:
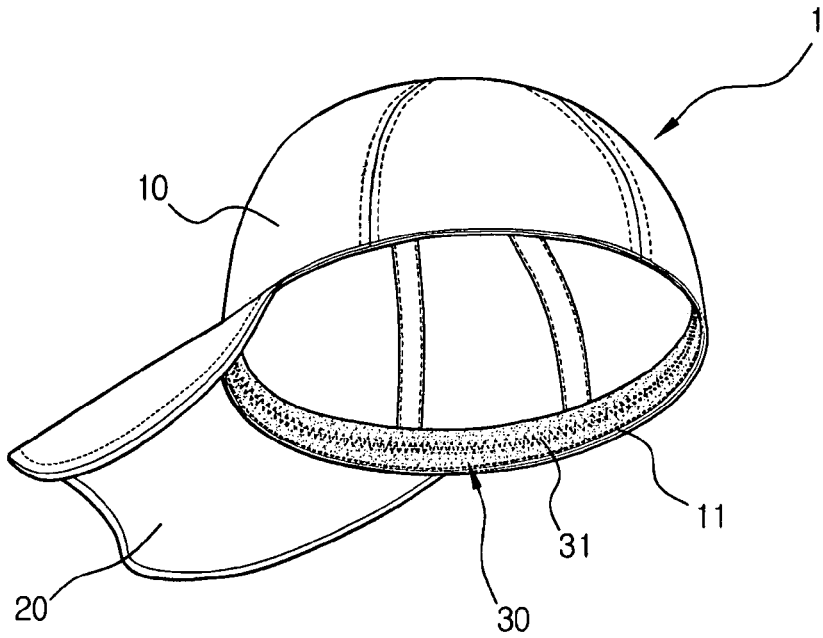
FIG. 2 is a perspective view showing the bottom portion of a headwear according to an embodiment of the present invention.
Figure 3:
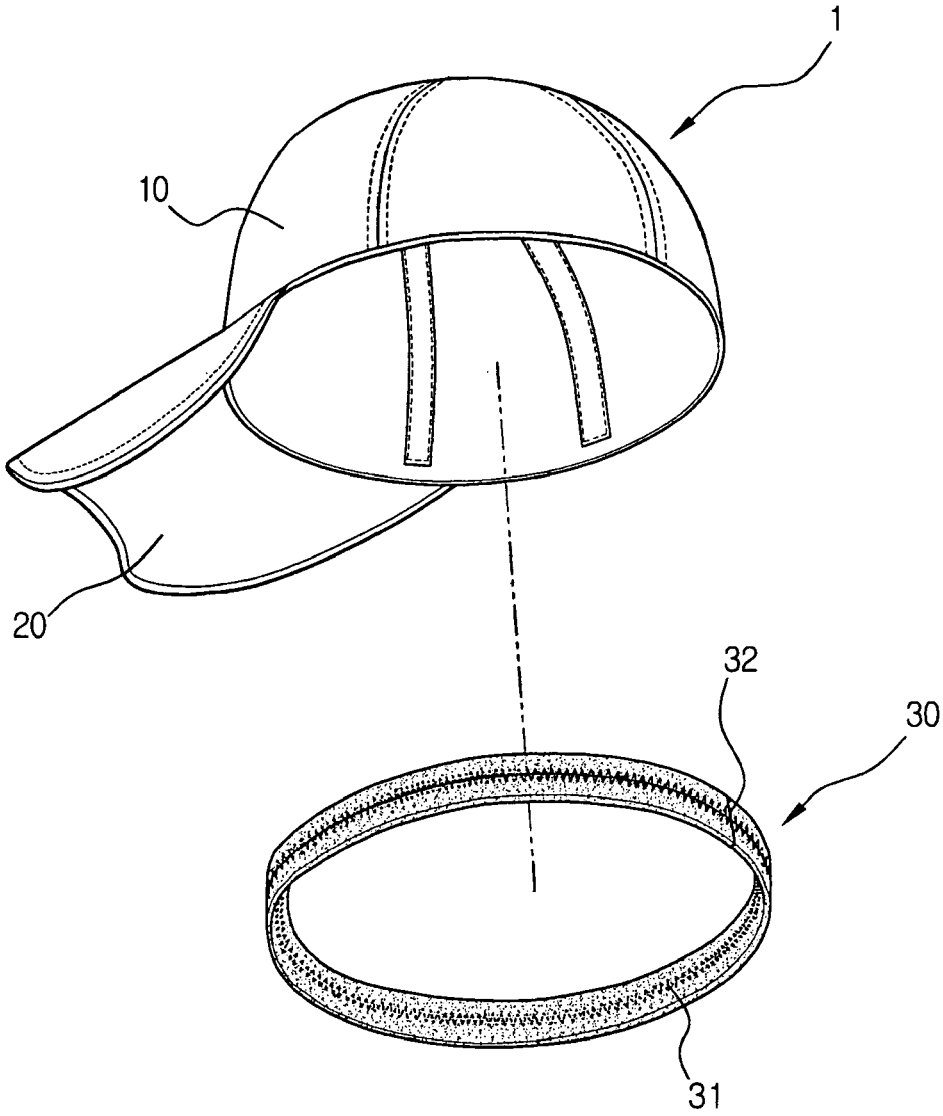
FIG. 3 is an exploded perspective view of the headwear with a rim in FIG. 2.
Figure 4:
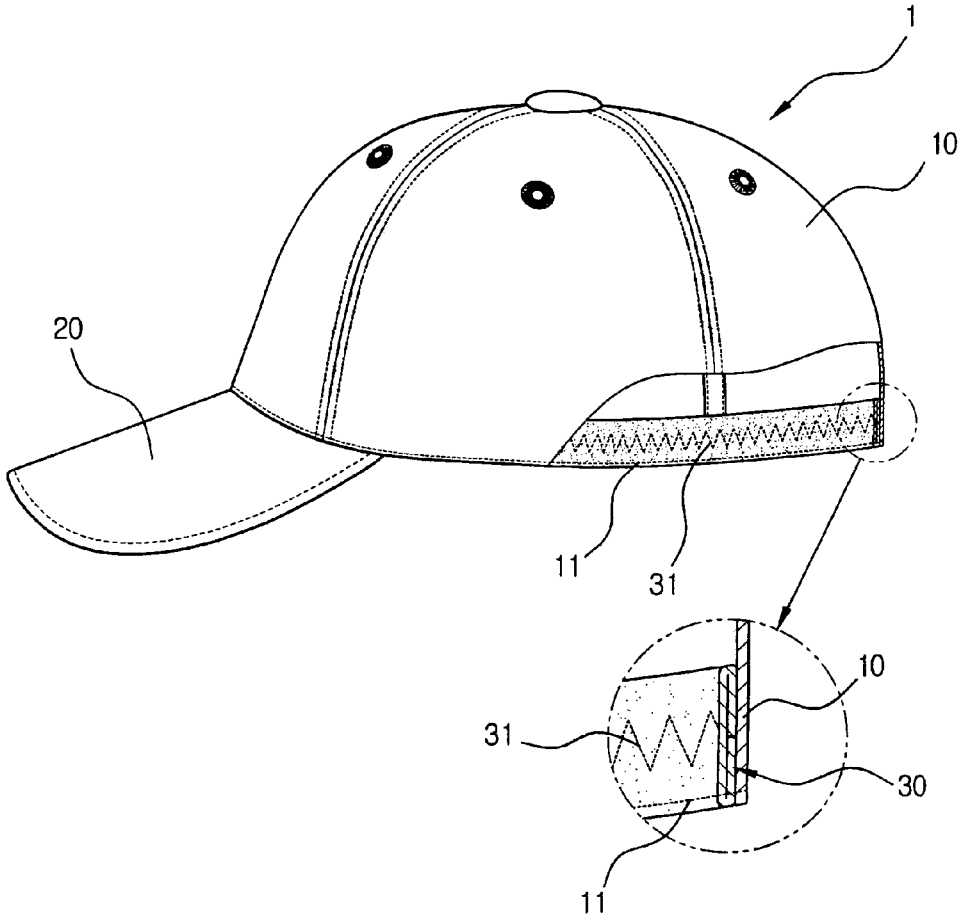
FIG. 4 is a partly sectional view of the headwear of FIG. 2.
Figure 5:
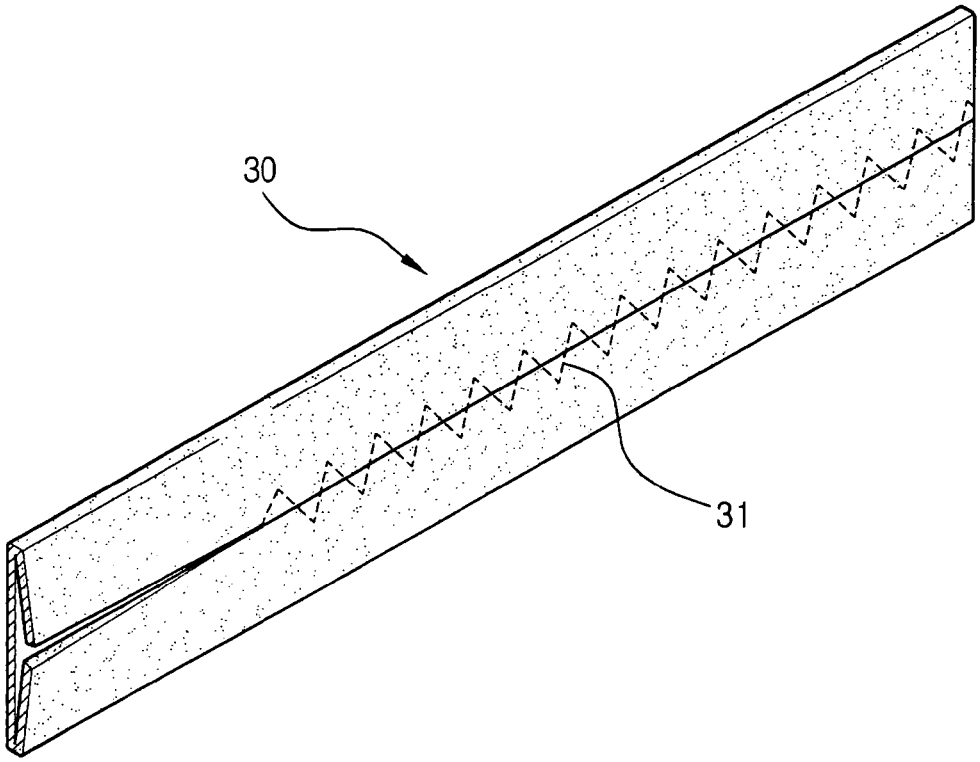
FIG. 5 is a perspective view of the rim in FIG. 2.

Reference will now be made in detail to the preferred embodiments of the present invention, examples of which are illustrated in the accompanying drawings.

As shown in FIGS. 2 to 5, headwear 1 like a cap includes a dome-shaped crown 10 opened at a bottom thereof to cover the top of a wearer's head, a brim 20 formed in a predetermined shape at one side of the lower peripheral edge of the dome-shaped crown 10, and a rim 30 sewn along the inner peripheral surface of the lower peripheral edge of the crown 10.

It is of course well known that the cap 1 has the above-mentioned construction. However, one of features of the present invention resides in that the rim 30 is made of a spandex material having an excellent expandability, such that the cap is freely worn within the range of the degree of expansion, irrespective of a wearer's head size.

In other words, the rim 30 is made of the spandex material, which gives a very smooth wearing feeling, and has a sewing line 31 formed in a zigzag way along a portion met by folding the upper and lower portions of the spandex material.

The lower portion of the rim is fixedly attached onto the inner peripheral surface of the lower peripheral edge of the crown 10 by a straight sewing line 11 sewn along the inner peripheral surface of the inner peripheral edge of the crown 10, and the upper portion thereof does not have any sewing line, so that the rim can be expanded freely.

Figure 6A:
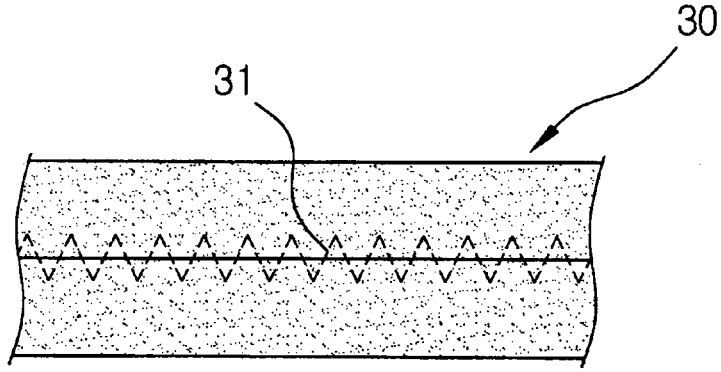
FIGS. 6*a* and 6*b* are front views showing the expanded examples of the rim in FIG. 2.
Figure 6B:
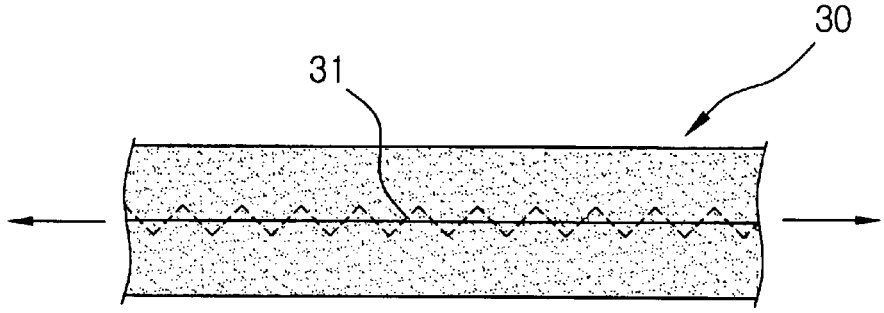

If the sewing line 31 that is formed in the zigzag way on the rim 30 as shown in FIG. 6*a* is pulled at the both sides thereof, it is expanded, as shown in FIG. 6*b*, as the intervals of the peaks of the sewing line 31 are widened. Therefore, the spandex material exhibits its original expandability irrespective of the formation of the sewing line 31, thereby achieving an excellent expansion.

The spandex is a synthetic fabric that is made of a polyurethane elastic yarn wherein polyether and methylene-dipheylisocyanate are polymerized and melt-spun, such that it exhibits higher strength by about three times as much as an elastic thread, is expanded to be longer by about 5 to 8 times as much as its original length, is lighter than the elastic thread, and exhibits an excellent aging resistance. In recent days, thus, the spandex is widely used as a raw yarn for the elastic goods like underwear, swimming suits, sportswear, and so on.

According to the present invention, the rim 30 that is disposed along the inner peripheral surface of the lower peripheral edge of the crown 10 is made of the spandex material, and if the cap 1 is worn, the rim 30 is expanded such that the cap 1 is freely worn within the range of the degree of expansion, irrespective of the size of a wearer's head. As the rim 30 is expanded, the wearer wears the cap 1 with a good wearing sense and further, the processes where the cap having different sizes is made can omitted.

Additionally, since the rim 30 is made of the smooth spandex fabric, unlike the rubber band, it exhibits an excellent sweat absorbing capability and a good wearing sense.

Figure 7:
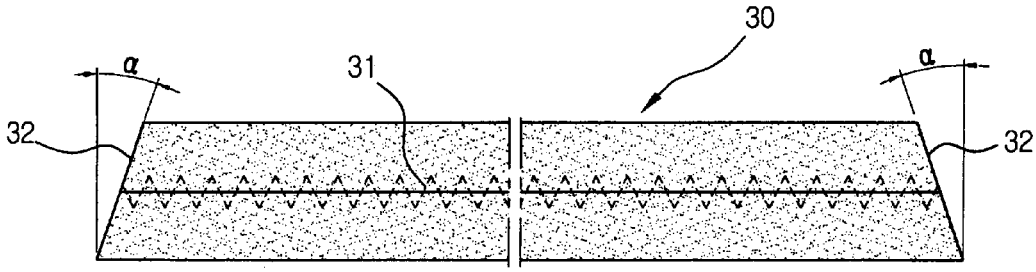
FIG. 7 is a front view of the rim in FIG. 2.

On the other hand, the formation of the straight sewing line 11 for sewing the rim 30 along the inner peripheral surface of the lower peripheral edge of the crown 10 makes the degree of expansion of the rim 30 substantially low, and thus, as shown in FIG. 7, the rim 30 is cut at a predetermined angle of inclination at the both sides thereof, and the two inclined faces 32 are met and sewn to each other, such that the rim 30 is ring-shaped in such a manner as to be narrowed at the upper sides thereof and to be widened as it goes toward the lower side thereof.

At that time, when the cap 1 is worn, the rim 30 is a little expanded at the lower portion thereof, but it elastically fits and expands around the wearer's head at the upper portion thereof. This enables the rim 30 to be effectively and freely expanded.

Preferably, if the crown 10 of the cap 1 is made of the spandex material, the crown 10 and the rim 30 are expanded together, such that the cap 1 can be expanded to a larger degree than before.

Figure 8:
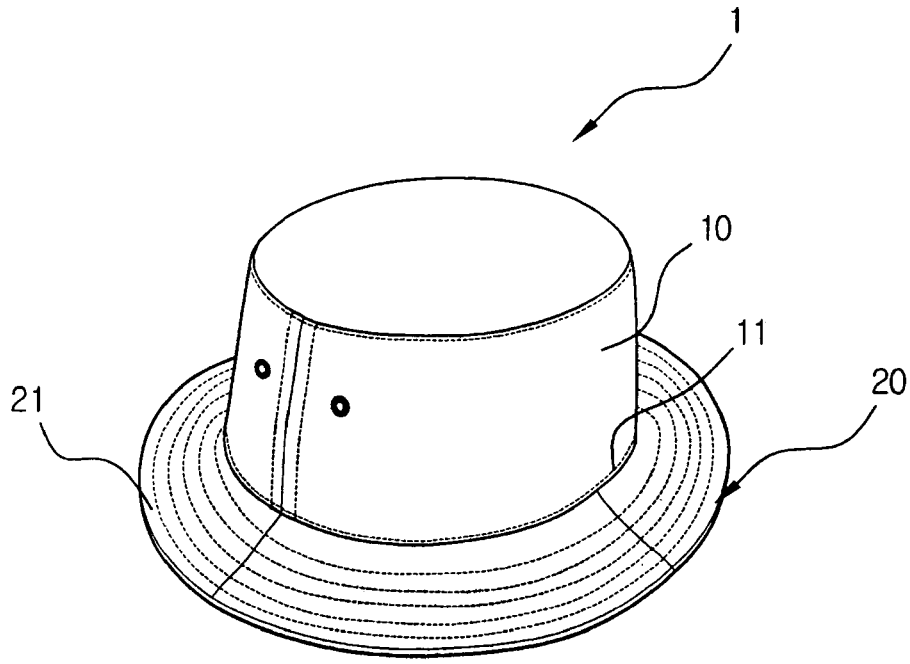
FIG. 8 is a perspective view of a hat according to another embodiment of the present invention.
Figure 9:
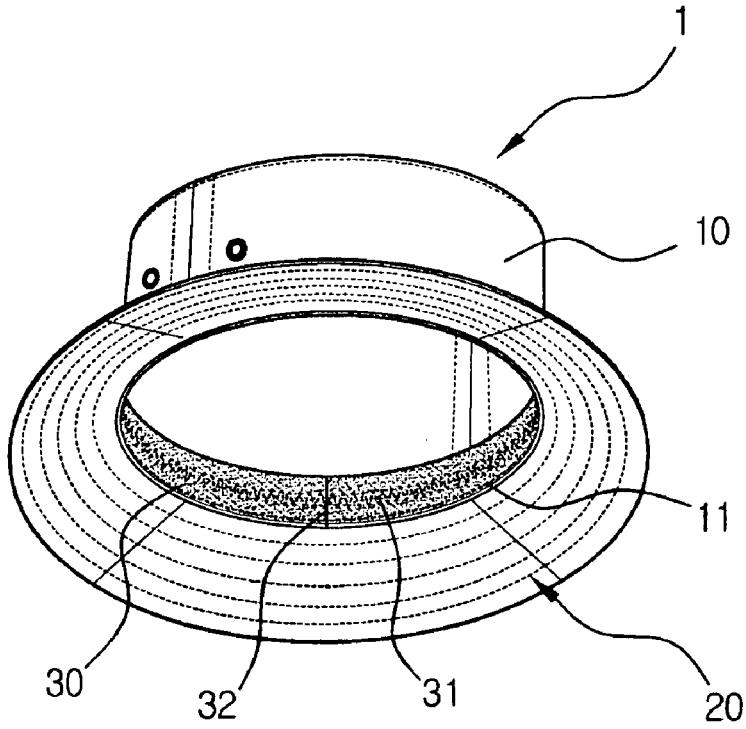
FIG. 9 is a perspective view showing the bottom portion of the hat of FIG. 8.
Figure 10:
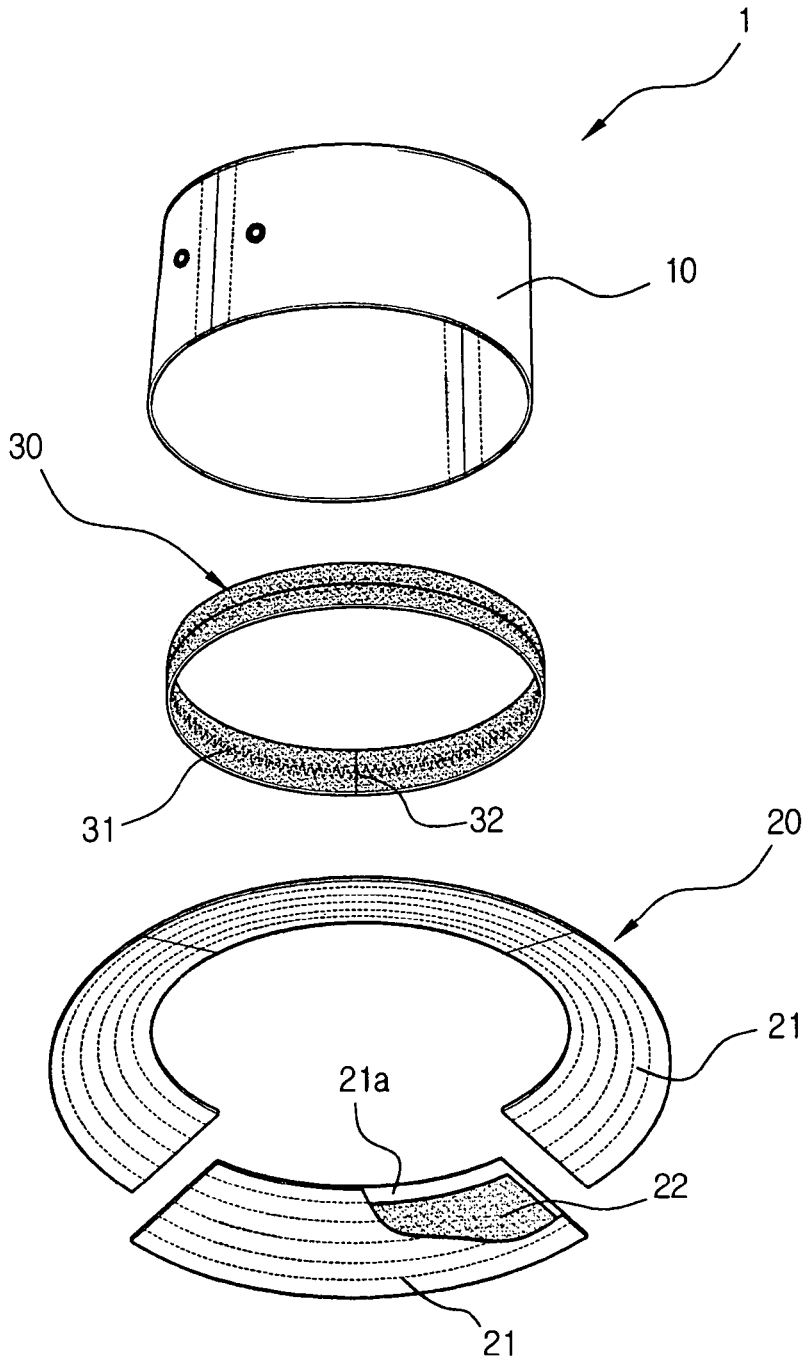
FIG. 10 is an exploded perspective view of the hat with a rim in FIG. 9.
Figure 11:
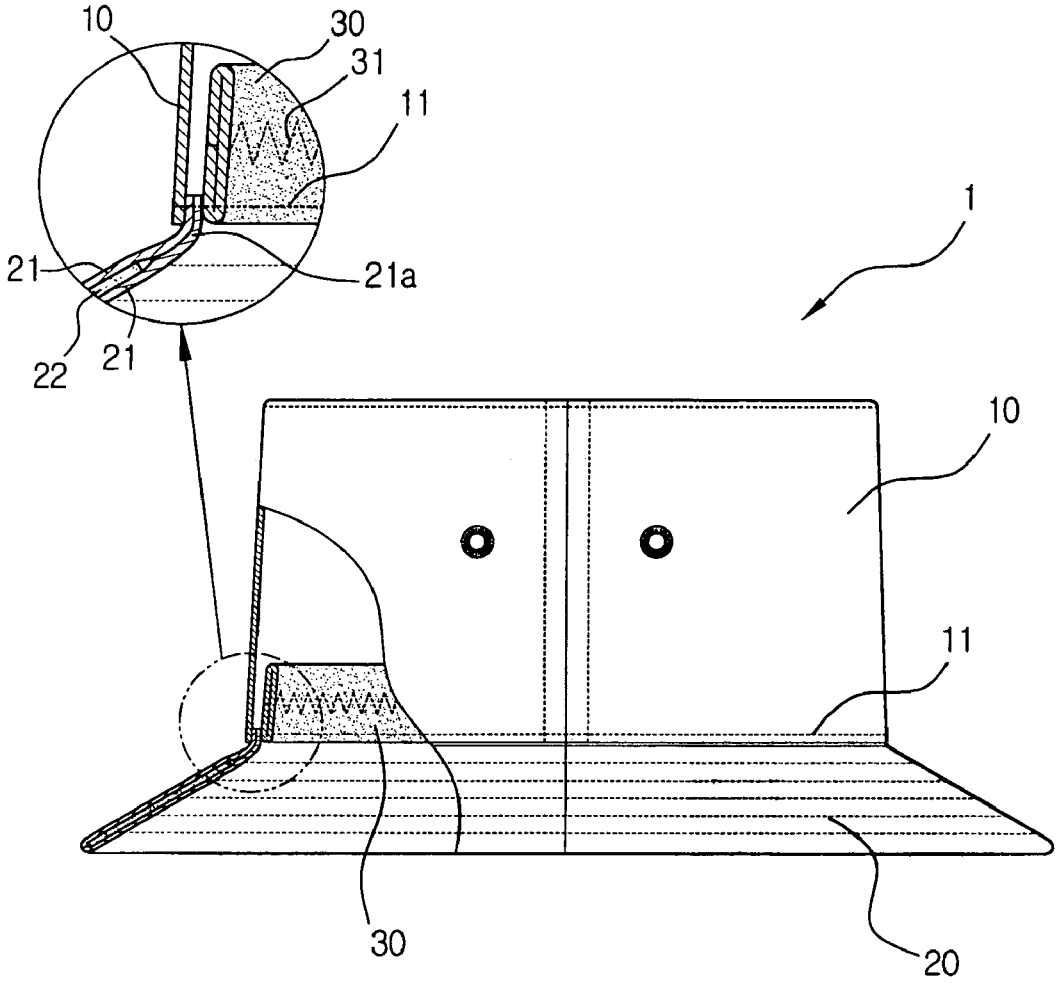
FIG. 11 is a partly sectional view of the hat of FIG. 8.
Figure 12:
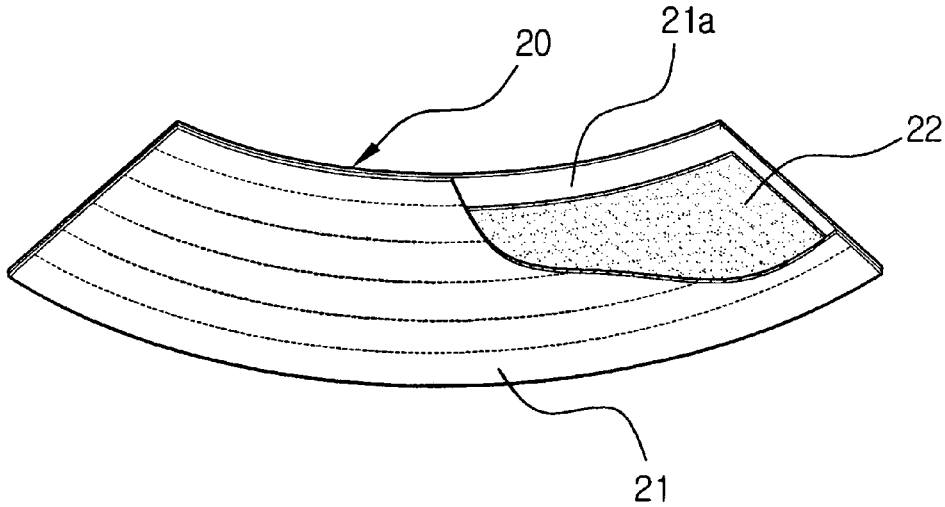
FIG. 12 is a bottom perspective view showing a part of the brim of the hat of FIG. 8.

Meantime, FIGS. 2 to 5 show the headwear 1 like a cap having a brim formed at one side of the lower peripheral edge of the dome-shaped crown 10, provided with the rim 30 formed along the inner peripheral surface of the lower peripheral edge of the crown 10, but FIGS. 8 and 12 shows the headwear 1 like a hat having a ring-shaped brim 20 formed along the lower peripheral edge of a truncated cylindrical-shaped crown 10. Even in this case, of course, the rim 30 of the present invention can be embodied, and in the same manner as above, the present invention may be applied to a variety of kinds of headwear.

In other words, in case of the hat type headwear 1 having the brim 20 formed along the lower peripheral edge of the truncated cylindrical-shaped crown 10, the brim 20 includes an outer cover 21 shaped to fit the size of the brim, a seam material 22 inserted into the outer cover such that the outer cover 21 and the seam material 22 are stitched together. In this case, the outer cover 21 is made of a spandex fabric. Also, the brim 20 has an elastic extended portion 21*a* formed along the innermost peripheral portion 21*a* of the brim 20 in such a manner as to be inwardly extended beyond the seam material 22, such that the extended portion 21*a* is sewn along the inner peripheral surface of the lower peripheral edge of the crown, along with the rim.

Under the above construction where the elastic outer cover 21 is formed longer than the seam material 22 that does not have any elasticity to thus have the extended portion 21*a* along the inner peripheral surface thereof, the elastic extended portion 21*a* of the outer cover 21, the spandex crown 10, and the spandex rim 30 are stitched and fixed together by the formation of the straight sewing line 11. Since the portions sewn onto one another are made of the spandex material, therefore, the headwear 1 can be freely expanded. In the same manner as the above-mentioned embodiment, the hat type headwear 1 has the rim 30 that is expandable, such that the hat 1 is freely worn within the range of the degree of expansion, irrespective of a wearers head size.

Figure 13:
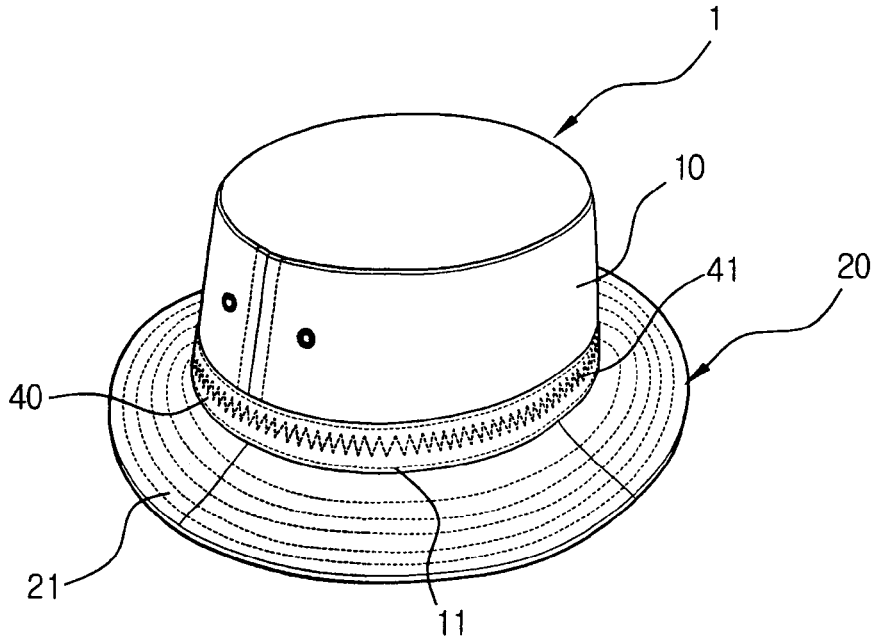
FIG. 13 is a perspective view of a hat according to still another embodiment of the present invention.
Figure 14:
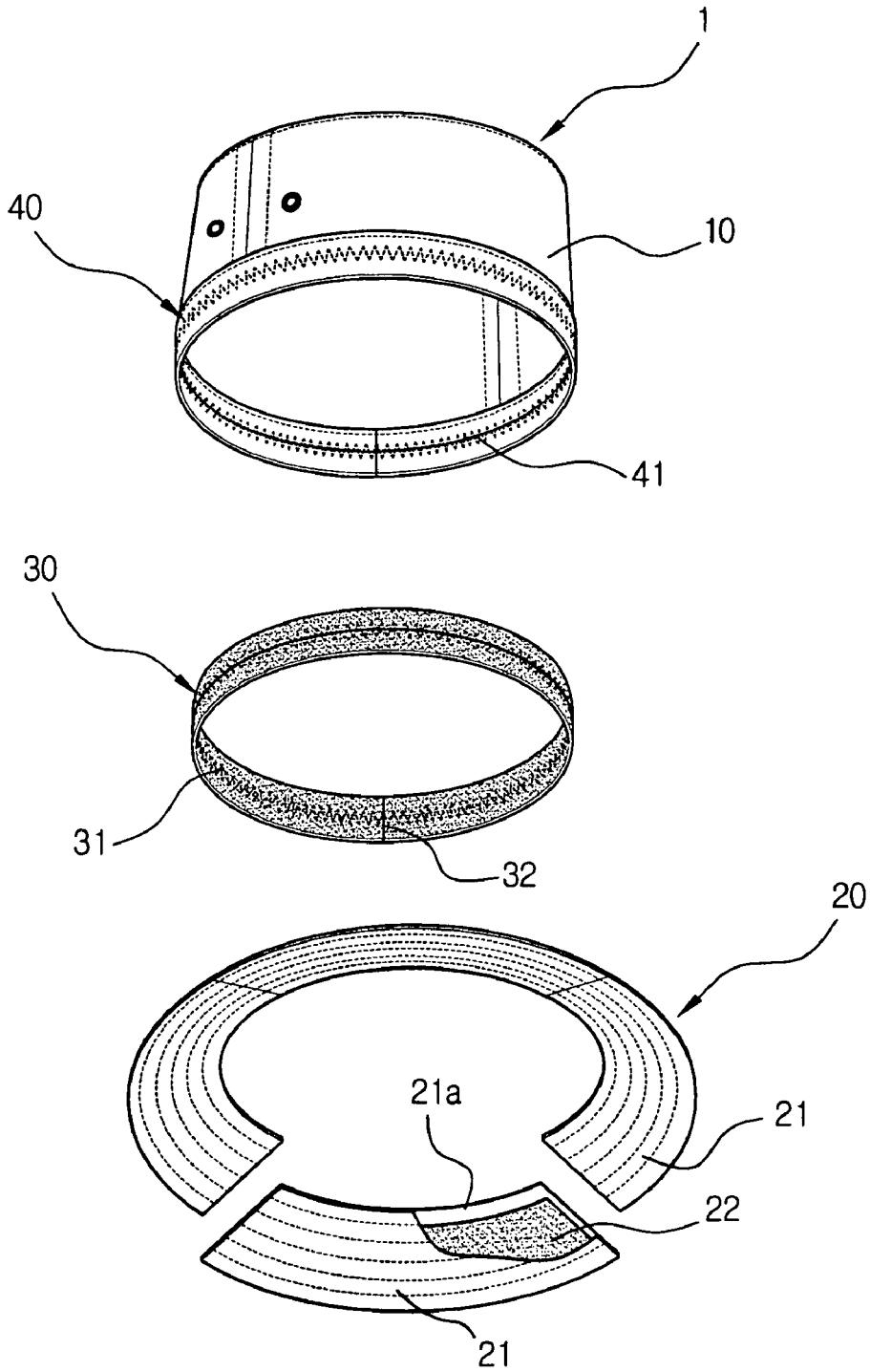
FIG. 14 is an exploded perspective view of the hat with a rim in FIG. 13.
Figure 15:
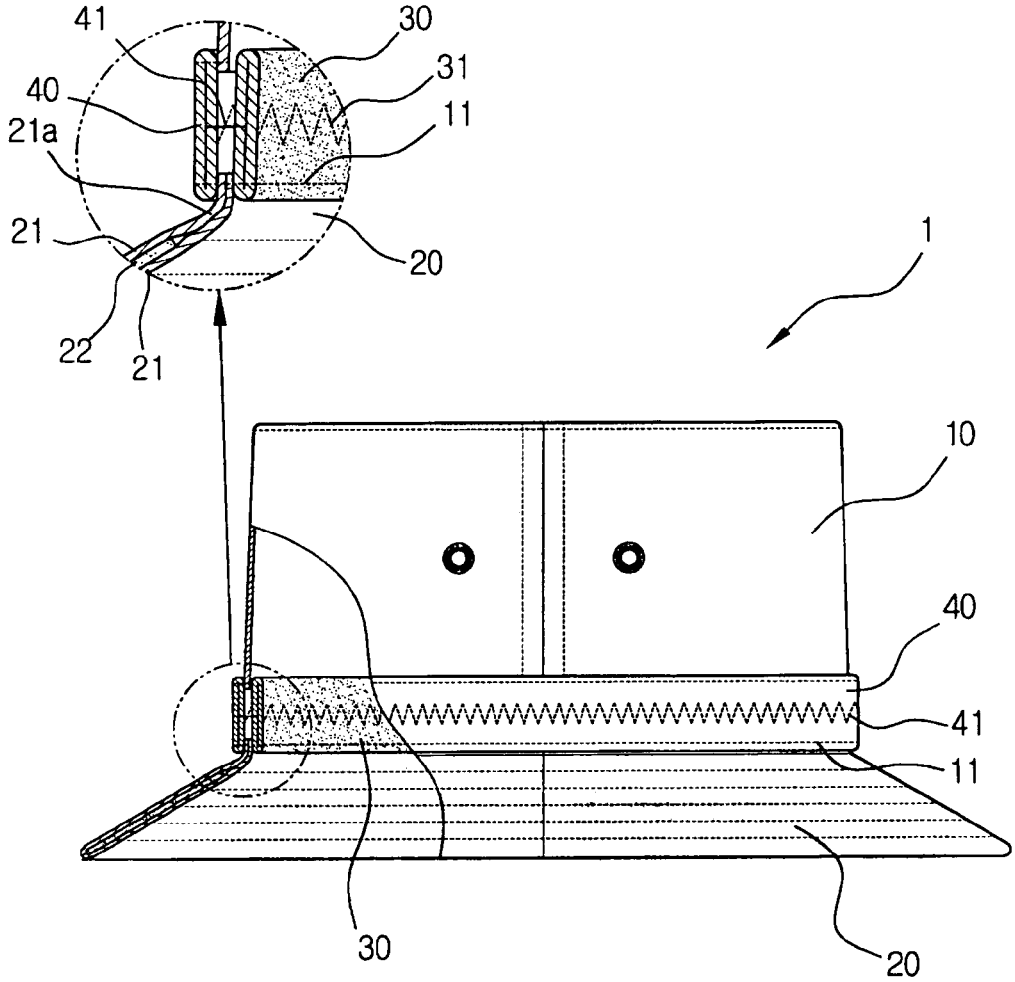
FIG. 15 is a partly sectional view of the hat of FIG. 13.

As shown in FIGS. 13 to 15, in the case where the crown 10 of the headwear 1 is not expandable, an expandable connecting band 40 is sewn along the inner peripheral surface of the lower peripheral edge of the crown 10, and then, the expandable connecting band 40 is sewn, together with an extended piece 21*a* of the outer cover 21 and the rim 30, along the inner peripheral surface of the lower peripheral edge of the crown 10.

The connecting band 40 has a sewing line 41 formed in a zigzag way along a portion where the upper and lower portions of the spandex material are folded to meet with each other such that the connecting band 40 is expandable along the sewing line 41 thereon.

Like this, in the case of having the additional connecting band 40, the crown 10 may be made of a fabric having no elasticity, and in this case, with the formation of the connecting band 40 made of the spandex material, the connecting portion of the brim 20 and the rim 30 has a high degree of expansion, which improves the expansion of the rim 30, while maintaining making the headwear at a relatively low cost. Furthermore, such a hat 1 is freely worn within the range of the degree of expansion, irrespective of a wearers head size.

As described above, the headwear according to the present invention is provided with a rim that is formed along the inner peripheral surface of the lower peripheral edge of a crown, the rim being made of a spandex material and having a sewing line formed in a zigzag way along a portion where the upper and lower portions of the spandex material are folded to meet with each other, thereby providing a high degree of expansion, such that the headwear is freely worn within the range of the degree of expansion, irrespective of a wearer's head size, giving some advantages like an excellent sweat absorbing capability, conveniences in use, and satisfaction of wearing.

Also, the sewing line 31 that is formed in the zigzag way on the rim 30 is freely expanded as the intervals of the peaks thereof are widened, such that the spandex material exhibits its original expandability irrespective of the formation of the sewing line 31, thereby achieving an excellent expansion.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An article of headwear comprising:

a crown adapted to cover a top portion of a wearer's head wherein the crown has a lower peripheral edge and an inner peripheral surface;

a brim formed in a predetermined shape at a lower peripheral edge of the crown;

a rim formed along an inner peripheral surface of the lower peripheral edge of the crown;

wherein the crown is made of a substantially non-expandable fabric, the rim is made of a spandex material and has a sewing line formed in a zigzag pattern along a portion where upper and lower portions of the spandex material are folded to meet with each other so that the sewing line is stretchable;

wherein the brim is constructed with a seam material inserted into a spandex outer cover with the seam material and the outer cover stitched together and an elastic extended portion formed along the inner peripheral edge of the brim and with the outer cover formed longer than the seam material; and wherein an expandable connecting band is formed to correspond to the rim wherein a sewing line is formed in a zigzag pattern along a portion where the upper and lower portions of the spandex fabric are folded to meet with each other at the outer peripheral surface of the lower peripheral edge of the crown whereby the connecting band is expandable along the sewing line thereon; and wherein the elastic extended portion is formed between the expandable rim and the expandable connecting band whereby the elastic extending portion, the rim and the expandable connecting band are stitched together.

2. The article of headwear of claim 1 wherein the rim has inclined faces formed at a predetermined angle of inclination at opposite sides thereof, wherein the inclined faces are met with and sewn to each other, and wherein the rim is generally ring-shaped and narrowed at upper sides thereof and widened as the rim approaches the lower sides thereof.

* * * * *